US008061799B2

(12) United States Patent
Kimura

(10) Patent No.: US 8,061,799 B2
(45) Date of Patent: Nov. 22, 2011

(54) LIQUID EJECTING APPARATUS, LIQUID CONTAINER, AND DATA WRITING METHOD

(75) Inventor: Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 678 days.

(21) Appl. No.: 12/233,058

(22) Filed: Sep. 18, 2008

(65) Prior Publication Data

US 2009/0079775 A1 Mar. 26, 2009

(30) Foreign Application Priority Data

Sep. 21, 2007 (JP) ..... 2007-245502

(51) Int. Cl.
*B41J 29/393* (2006.01)

(52) U.S. Cl. ..... 347/19; 347/7

(58) Field of Classification Search ..... 347/7, 14, 347/19, 81

See application file for complete search history.

(56) References Cited

U.S. PATENT DOCUMENTS 5,706,037 A * 1/1998 McIntyre ..... 347/3
6,994,416 B2 * 2/2006 Seki et al. ..... 347/19

FOREIGN PATENT DOCUMENTS

JP 2004-188634 7/2004
JP 2004-314642 11/2004

* cited by examiner

*Primary Examiner* — Thinh Nguyen

(57) ABSTRACT

A liquid ejecting apparatus ejects a liquid supplied from a liquid container including a storage unit in which data is written and a liquid level detector which detects a liquid level of the contained liquid. The liquid ejecting apparatus includes: an abnormality detecting unit which receives a signal indicating the liquid level of the liquid from the liquid level detector and analyzes the signal to detect abnormality of the liquid level detector; and a writing unit which writes data indicating the abnormality in the storage unit when the abnormality is detected.

13 Claims, 5 Drawing Sheets

FIG. 2

| ADDRESS | INFORMATION DETAILS | |
|---|---|---|
| a | TYPE NUMBER DATA | INDIVIDUAL INFORMATION AREA |
| b | SERIAL NUMBER DATA | |
| c | INK TYPE DATA | |
| d | COLOR DATA | |
| e | CAPACITY DATA | |
| f | MANUFACTURE DATE DATA | |
| g | MANUFACTURE LINE DATA | |
| h | OPENED DATE DATA | WRITING AREA |
| i | CONSUMPTION INK DATA | |
| j | ABNORMALITY DETERMINATION RESULT DATA | |

| | EXISTENCE OF REMAINING INK | NON-EXISTENCE OF REMAINING INK |
|---|---|---|
| OPERATION OF PUMP | INK EXISTENCE SIGNAL | INK NON-EXISTENCE SIGNAL |
| STOP OF PUMP | INK NON-EXISTENCE SIGNAL | INK NON-EXISTENCE SIGNAL |

LIQUID EJECTING APPARATUS, LIQUID CONTAINER, AND DATA WRITING METHOD

BACKGROUND

1. Technical Field

The present invention relates to a technique capable of writing data in a storage unit mounted in a liquid container.

2. Related Art

A liquid ejecting apparatus such as an ink jet printing machine or a micro-dispenser receives a liquid such as ink from a liquid container and ejects the liquid. The liquid container is provided with a non-volatile storage unit in which a manufactures date, a manufacturer, a serial number, and the like of the liquid container are stored.

The liquid ejecting apparatus can record various types of information in a storage unit provided in the liquid container. For example, JP-A-2004-188634 discloses a storage unit in which as information on a printing apparatus, a serial number of the printing apparatus, information such as the number of jam occurrences, cumulative operation time of the printing apparatus, and the number of print paper sheets are stored. In addition, in JP-A-2004-314642, as data on a use record of a liquid container, information on a cleaning situation, an exchange situation, and a final user is stored.

Manufacturers of the liquid containers can recover the used liquid containers and easily gather the information on the liquid ejecting apparatuses or the information on use situation of the liquid containers by analyzing the information stored in the storage units. However, in order to improve a quality of the liquid container and deal with problems with the liquid container, other useful information other than the above-described information has to be stored.

SUMMARY

An advantage of some aspects of the invention is that it provides a technique capable of writing useful information in a storage unit provided in a liquid container.

According to an aspect of the invention, there is provided a liquid ejecting apparatus which ejects a liquid supplied from a liquid container including a storage unit in which data is written and a liquid level detector which detects a liquid level of the contained liquid. The liquid ejecting apparatus includes: an abnormality detecting unit which receives a signal indicating the liquid level of the liquid from the liquid level detector and analyzes the signal to detect abnormality of the liquid level detector; and a writing unit which writes data indicating the abnormality in the storage unit when the abnormality is detected.

According to the liquid ejecting apparatus having the above-described configuration, the data indicating the abnormality of the liquid level detector can be written in the storage unit provided in the liquid container. Accordingly, a person recovering the used liquid container can analyze the data stored in the storage unit and analyze information on frequency how many times the abnormality occurs in the liquid level detector among the constituent elements of the liquid container, time at which the abnormality occurs in the liquid level detector, and a manufacture date or a manufacture place in which the abnormality easily occurs.

The liquid ejecting apparatus having the above-described configuration may further include a pressurizing unit which pressurizes the liquid contained in the liquid container. The liquid container supplies the liquid to the liquid ejecting apparatus when the liquid is pressurized by the unit pressurizes. In addition, the abnormality detecting unit analyzes the signal indicating the liquid level of the liquid received from the liquid level detector and whether the pressurizing unit pressurizes the liquid to detect the abnormality of the liquid level detector.

With such a configuration, it is possible to detect the abnormality of the liquid level detector with good precise in accordance with the pressurization and non-pressurization of the pressurizing unit.

The liquid ejecting apparatus having the above-described configuration may further include an estimation unit which estimates an amount of consumption liquid on the basis of the number of times of liquid ejection. The abnormality detecting unit analyzes the signal indicating the liquid level of the liquid received from the liquid level detector and the amount of estimated consumption liquid to detect the abnormality of the liquid level detector.

Specifically, the liquid level detector may output a low level signal indicating that the liquid level is low when the liquid level of the liquid contained in the liquid container is equal to or less than a predetermined level. In addition, the abnormality detecting unit may determine that the abnormality occurs when the amount of estimated consumption liquid does not reach the predetermined level but the low level signal is received. Moreover, the abnormality detecting unit may determine that the abnormality occurs when the amount of estimated consumption liquid exceeds the predetermined level but the low level signal is not received.

With such a configuration, it is possible to detect the abnormality of the liquid level detector with good precise by estimating the amount of consumption liquid.

In the liquid ejecting apparatus having the above-described configuration, the writing unit may write the data indicating the abnormality and the data indicating the amount of estimated consumption liquid in the storage unit. With such a configuration, it is possible to analyze a tendency of the amount of estimated consumption liquid at the point of time at which the abnormality occurs.

In the liquid ejecting apparatus having the above-described configuration, the storage unit may include an exclusive area where only the data indicating the abnormality is written. With such a configuration, it is possible to analyze the data with ease.

In the liquid ejecting apparatus having the above-described configuration, individual information relating to the liquid container may be written in the storage unit, and the writing unit may rewrite at least a part of the individual information with the data indicating the abnormality. With such a configuration, it is possible to save the storage capacity of the storage unit.

According to another aspect of the invention, there is provided a liquid container which contains a liquid to be supplied to a liquid ejecting apparatus. The liquid container includes: a liquid level detector which detects a liquid level of the liquid contained in the liquid container and outputs a signal indicating the liquid level of the liquid to the liquid ejecting apparatus; and a storage unit which includes a storage area where data indicating abnormality of the liquid level detector is written by the liquid ejecting apparatus when the abnormality is detected by analyzing the signal indicating the liquid level of the liquid by the liquid ejecting apparatus.

In the storage unit of the liquid container having the above-described configuration, the data indicating the abnormality of the liquid level detector is written. Accordingly, a person recovering the used liquid container can analyze the data stored in the storage unit and analyze information on frequency how many times the abnormality occurs in the liquid level detector among the constituent elements of the liquid container, time at which the abnormality occurs in the liquid level detector, and a manufacture date or a manufacture place in which the abnormality easily occurs.

The invention may be realized by a method of writing the data by the liquid ejecting apparatus or a computer program for writing the data in addition to the liquid ejecting apparatus or the liquid container described above. The computer program may be stored in a recording medium readable by a computer. Examples of the recording medium include a flexible disk, a CD-ROM, a DVD-ROM, a magnetic optical disk, a memory card, and a hard disk.

BRIEF DESCRIPTION OF THE DRAWINGS

The invention will be described with reference to the accompanying drawings, wherein like numbers reference like elements.

FIG. 2 is an explanatory diagram illustrating information stored in an EEPROM.

DESCRIPTION OF EXEMPLARY EMBODIMENTS

Hereinafter, embodiments of the invention will be described in the following order.

A. First Embodiment
- (A1) Configuration of Liquid Ejecting Apparatus
- (A2) Configuration of Liquid Container
- (A3) Abnormality Determination Process B. Second Embodiment C. Modified Examples

A. First Embodiment

(A1) Configuration of Liquid Ejecting Apparatus

Figure 1:
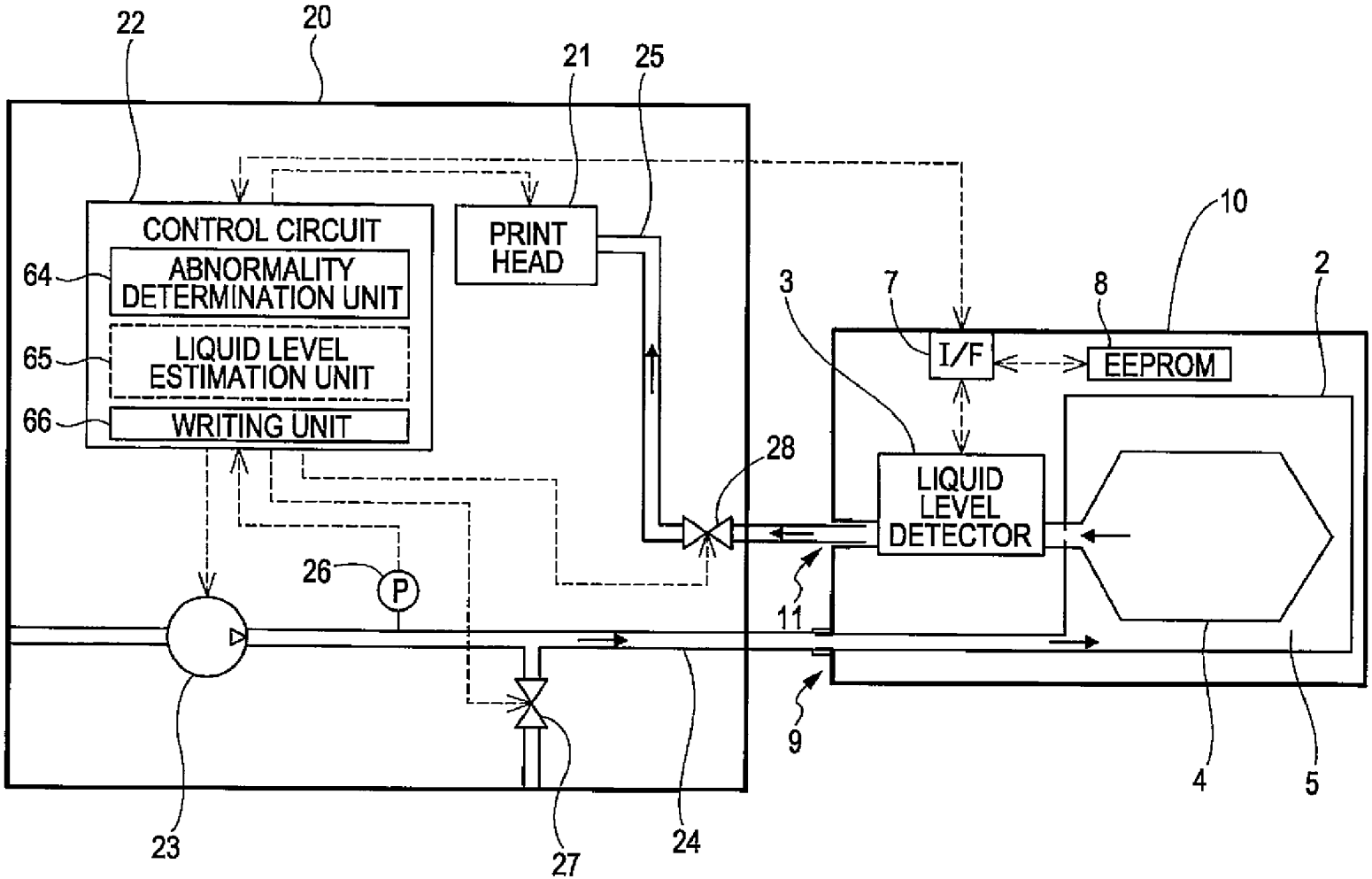
FIG. 1 is an explanatory diagram illustrating an overall configuration of a liquid ejecting apparatus.

FIG. 1 is an explanatory diagram illustrating an overall configuration of a liquid ejecting apparatus 20. In this embodiment, the liquid ejecting apparatus 20 is an ink jet printing device which prints images or texts by ejecting ink onto a printing sheet from a print head 21. The liquid ejecting apparatus 20 is provided with a liquid container 10 containing ink. The liquid container 10 is an ink jet type container which is detachably mounted to supply the ink to the print head 21 of the liquid ejecting apparatus 20.

As shown in FIG. 1, the liquid ejecting apparatus 20 includes a pressuring pump 23 pressurizing air and an air passage 24 supplying pressurized air to the liquid container 10. The liquid ejecting apparatus 20 includes an ink passage 25 guiding the ink supplied from the liquid container 10 to the print head 21 and the print head 21 ejecting the ink onto a printing sheet. The liquid ejecting apparatus 20 further includes a control circuit 22 which controls the print head 21 to perform a printing process and an abnormality determination process, which is described below.

The air pressurized by a pressurizing pump 23 is supplied to the liquid container 10 via the air passage 24. A pressure sensor 26 and an air opening value 27 are provided in the air passage 24. The pressure sensor 26 and the air opening value 27 are connected to the control circuit 22. The control circuit 22 permits the pressure sensor 26 to detect the pressure of air in the air passage 24 and perform a feedback control of the pressurizing pump 23 on the basis of the pressure.

The ink supplied from the liquid container 10 is guided to the print head 21 via the ink passage 25. A switching valve 28 is provided in the ink passage 25. The switching value 28 is closed by the control circuit 22, when the liquid ejecting apparatus 20 is turned off or the liquid container 10 is detached from the liquid ejecting apparatus 20, for example. In addition, a check valve may be used as the switching value 28.

The control circuit 22 includes a CPU, a ROM, and a RAM. The CPU functions as an abnormality determining unit 64 or a writing unit 66 illustrated in the drawing by loading a control program stored in the ROM to execute the control program in the RAM. The abnormality determining unit 64 has a function analyzing a signal or the like output from the liquid container 10 to perform the abnormality determination process, which is described below. The writing unit 66 has a function writing data in an EEPROM 8 provided in the liquid container 10 via an interface board 7.

(A2) Configuration of Liquid Container

As shown in FIG. 1, the liquid container 10 includes a liquid containing chamber 2 containing the ink, a liquid level detector 3 detecting a liquid level of the ink contained in the liquid containing chamber 2, the EEPROM 8 in which various types of information on the liquid container 10 are written, and the interface board 7 electrically connecting the liquid container 10 with the liquid ejecting apparatus 20.

An air inflow port 9 and an ink supply port 11A is formed in a casing of the liquid container 10. The air inflow port 9 communicates with the liquid containing chamber 2 and the ink supply port 11 communicates with the liquid level detector 3. The air inflow port 9 is connected to the pressurizing pump 23 in the liquid ejecting apparatus 20 and the ink supply port 11 is connected to the print head 21 in the liquid ejecting apparatus 20, when the liquid container 10 is mounted in the liquid ejecting apparatus 20.

In the liquid containing chamber 2, a flexible ink pack 4 filling with the ink is provided in a pressuring chamber 5 to which the pressurized air flows from the air inflow port 9. The ink pack 4 is formed by preparing two aluminum laminated films formed by laminating an aluminum layer on a flexible resin film layer and joining the peripheral portions of the aluminum laminated films with each other. One end of the ink pack 4 communicates with the ink supply port 11 via the liquid level detector 3.

When the pressurized air flows in the pressurizing chamber 5 from the liquid ejecting apparatus 20 through the air inflow port 9, the ink pack 4 is pressed by the pressurized air. Then, the ink is pressed and output from the ink pack 4, and the ink is supplied to the print head 21 of the liquid ejecting apparatus 20 via the liquid level detector 3 and the ink supply port 11.

The liquid level detector 3 and the EEPROM 8 are electrically connected to the interface board 7. The liquid level detector 3 and the EEPROM 8 are electrically connected to the control circuit 22 of the liquid ejecting apparatus 20 through the interface board 7, when the liquid container 10 is mounted in the liquid ejecting apparatus 20. In addition, the interface board 7 may include a wireless communication circuit, for example, to carry out wireless communication with the control circuit 22.

FIG. 2 is an explanatory diagram illustrating information stored in the EEPROM 8. The EEPROM 8 which is a nonvolatile semiconductor memory includes an individual information area where information on the liquid container 10 is stored and a writing area where various types of data are to be written by the control circuit 22 of the liquid ejecting apparatus 20.

In the individual information area, there are stored (a) type number data indicating a type number of the liquid container 10, (b) serial number data indicating a serial number of the liquid container 10, (c) ink type data indicating the type of ink such as pigment ink or colorant ink, (d) color data indicating the colors of the contained ink, (e) capacity data indicating an amount of filled ink, (f) manufacture date data indicating the manufacture date of the liquid container 10, and (g) manufacture line data indicating manufacture equipment of the liquid container 10, for example.

In the writing area, there are stored in (h) opened date data indicating the date at which the liquid container 10 is opened, (i) consumption ink data indicating an amount of consumption ink, and (j) abnormality determination result data indicating the result of the abnormality determination process which is described below. The liquid ejecting apparatus 20 can perform various types of control by reading the data stored in the EEPROM 8. In this embodiment, the liquid container 10 includes the EEPROM 8 as the nonvolatile storage unit, but may includes a flash memory, a volatile memory including a backup battery, or a storage unit in which information is stored magnetically or optically.

Figures 3, 4:
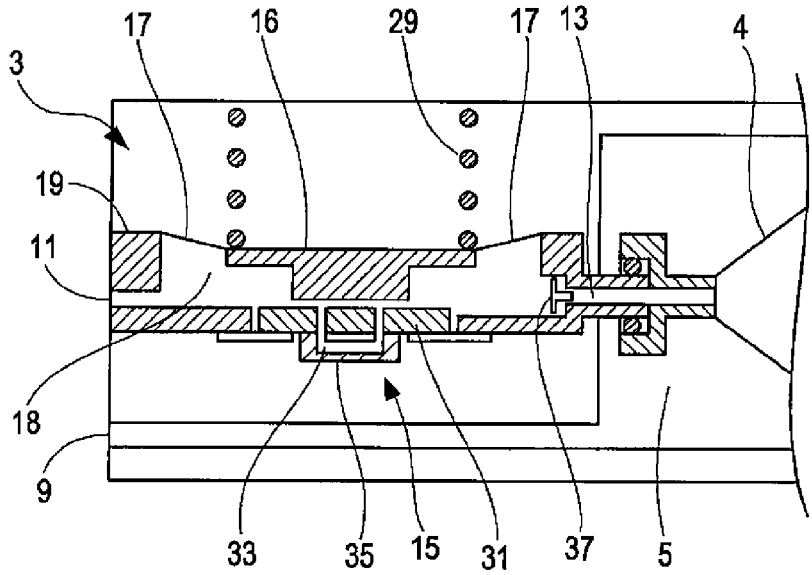
FIG. 3 is an explanatory diagram illustrating the detailed configuration of a liquid level detector.
FIG. 4 is a diagram illustrating the types of a liquid level signal output from a liquid container in accordance with the operation state of a pressurizing pump.

FIG. 3 is a sectional view illustrating the detailed configuration of the liquid level detector 3. As illustrated, the liquid level detector 3 includes a detector case 19 provided with a concave space therein and a flexible film 17 sealing an opening of the concave space. A space formed by the flexible film 17 and the concave space is referred to as a sensor chamber 18 below. A pressure detecting mechanism 15 detecting the pressure of ink flowing to the sensor chamber 18 is provided in the bottom of the sensor chamber 18. A pressure receiving plate 16 is formed in the middle portion of the flexible film 17 so as to be opposed to the pressure detecting mechanism 15. The pressure receiving plate 16 and the flexible film 17 are urged by coil springs 29 in a direction in which the capacity of the sensor chamber 18 is reduced.

An ink inflow passage 13 which communicates with the ink pack 4 in the liquid containing chamber 2 and the ink supply port 11 are formed on the side wall of the detector case 19 so as to be opposed to each other. A check value 37 preventing the ink from flowing backward to the ink pack 4 is formed in the ink inflow passage 13 connected to the ink pack 4. Even though not illustrated, the ink supply port 11 is provided with a valve mechanism by which a flow passage is opened by inserting an ink supply needle formed in the liquid ejecting apparatus 20 when the liquid container 10 is mounted in the liquid ejecting apparatus 20.

The pressure detecting mechanism 15 includes a bottom plate 31 with which the pressure receiving plate 16 can come in contact, an ink guide passage 33 which passes though the bottom plate 31 in the shape of U, and a piezoelectric sensor 35 which is electrically connected to the control circuit 22 of the liquid ejecting apparatus 20 through the interface board 7.

The ink pack 4 is pressed to flow the ink to the sensor chamber 18, when the pressurized air supplied from the liquid ejecting apparatus 20 flows to the pressurizing chamber 5. Then, the flexible film 17 is swollen and deformed upward by the pressure of the ink. The pressure receiving plate 16 is moved upward by the deformation of the flexible film 17 and separated from the bottom plate 31. Then, the ink guide passage 33 communicates with the sensor chamber 18. In this state, the piezoelectric sensor 35 as an actuator is exited for a predetermined period of time and a vibration plate of the piezoelectric sensor 35 starts free vibration, when the control circuit 22 of the liquid ejecting apparatus 20 applies a predetermined drive signal to the piezoelectric sensor 35 through the interface board 7. When the free vibration of the vibration plate occurs in this manner, a counter electromotive force is generated in the piezoelectric sensor 35. Then, a waveform representing the counter electromotive force is transmitted as an output signal to the control circuit 22 through the interface board 7. That is, the control circuit 22 can determine that a signal indicating "existence of ink" (hereinafter, referred to as "an ink existence signal") is output from the liquid container 10, when a signal having a predetermined waveform is output from the piezoelectric sensor 35 by applying the predetermined drive signal to the piezoelectric sensor 35 by the control circuit 22.

On the other hand, when an amount of ink remaining in the ink pack 4 becomes small, the amount of ink flowing from the ink pack 4 to the sensor chamber 18 is reduced and thus the pressure in the sensor chamber 18 becomes low, even though the ink pack 4 is pressurized. Accordingly, the pressure receiving plate 16 comes in contact with the bottom plate 31 and thus the ink guide passage 33 is closed. In this situation, the piezoelectric sensor 35 rarely vibrates in the ink guide passage 33 and thus a waveform representing small change is output, even when the control circuit 22 supplies the predetermined drive signal to the piezoelectric sensor 35. That is, the control circuit 22 can determine that a signal indicating "non-existence of ink" (hereinafter, referred to as "an ink non-existence signal") is output from the liquid container 10, when the waveform representing small change as an output signal. In addition "the non-existence of ink" means a state where the amount of ink remaining in the ink pack 4 is equal to or less than a predetermined level and does not mean a state where the amount of ink becomes exactly zero. The "predetermined level" can be appropriately changed by adjusting an elastic force of the coil springs 29. In the following description, "the ink existence signal" and "the ink non-existence signal" are together referred to as "a liquid level signal".

FIG. 4 is a diagram illustrating types of the liquid level signal output from the liquid container 10 in accordance with the operation state of the pressurizing pump 23. As illustrated, the liquid container 10 outputs the ink non-existence signal irrespective of whether the ink exists in the ink pack 4, when the pressurizing pump 23 of the liquid ejecting apparatus 20 stops. That is because the ink does not flow from the ink pack 4 to the liquid level detector 3, when the pressurized air is not supplied. However, in a state where the pressurizing pump 23 operates, the ink existence signal is output when the amount of the ink remaining in the ink pack 4 is equal to or more than a predetermined level. In addition, in the state where the pressurizing pump 23 operates, the ink non-existence signal is output when the amount of the ink remaining in the ink pack 4 is less than the predetermined level. The control circuit 22 of the liquid ejecting apparatus 20 can determine whether abnormality occurs in the liquid container 10 by comparing the liquid level signal output from the liquid container 10 with the types of the liquid level signal shown in FIG. 4.

(A3) Abnormality Determination Process

Figure 5:
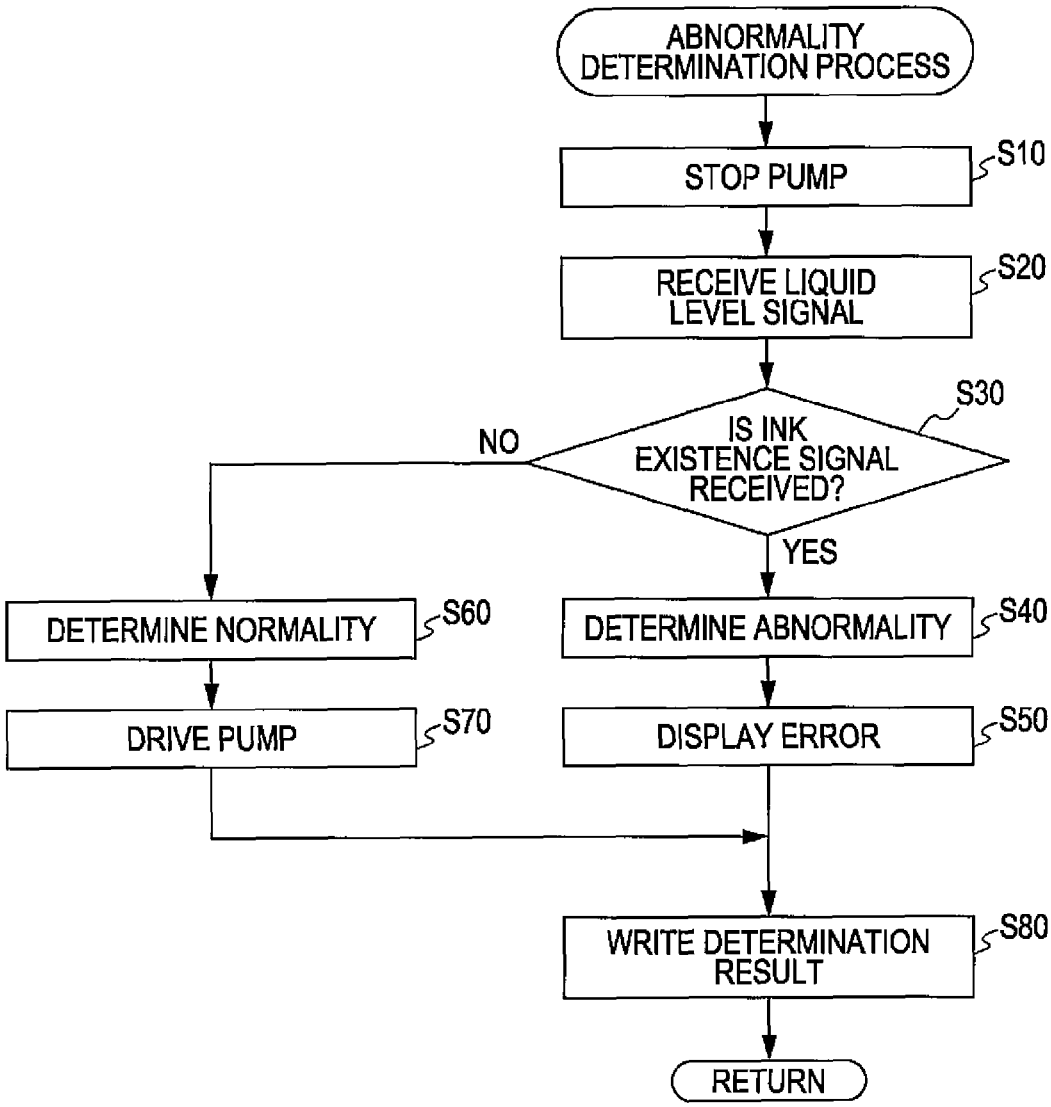
FIG. 5 is a flowchart illustrating an abnormality determination process according to a first embodiment.

FIG. 5 is a flowchart illustrating the abnormality determination process to be performed by the control circuit 22 of the liquid ejecting apparatus 20. For example, in the state where the liquid container 10 is mounted in the liquid ejecting apparatus 20, the abnormality determination process is performed when the liquid ejecting apparatus 20 is turned on.

When the abnormality determination process is performed, the control circuit 22 first stops the pressurizing pump 23 (Step S10). The liquid level signal is received from the liquid level detector 3 by applying a predetermined drive signal to the liquid level detector 3 of the liquid container 10 (Step S20).

When receiving the liquid level signal, the control circuit 22 determines whether the liquid level signal is the ink existence signal (Step S30). When receiving the ink existence signal (Yes in Step S30), it is analyzed that the ink existence signal is output even though the pressurizing pump 23 stops. Such analysis result is different from the types of the liquid level signal shown in FIG. 4. Accordingly, the control circuit 22 determines that the abnormality occurs in the liquid level detector 3 of the liquid container 10 (Step S40). Subsequently, an error indicating the abnormality is displayed on a display unit included in the control circuit 22 (Step S50).

Alternatively, when the liquid level signal received from the liquid container 10 is the ink non-existence signal (No in Step S30), the control circuit 22 determines that the liquid level signal received from the liquid level detector 3 is normal (Step S60), and then the control circuit 22 starts the drive of the pressurizing pump 23 (Step S70).

Finally, the control circuit 22 writes an abnormality determination result obtained in Step S40 or Step S60 as abnormality determination result data in the EEPROM 8 mounted in the liquid container 10 using the function of the writing unit 66 (step S80).

According to the first embodiment described above, the liquid ejecting apparatus 20 can determine whether the abnormality occurs in the liquid level detector 3 of the liquid container 10 by analyzing the drive states of the pressurizing pump 23 and the liquid level signal output from the liquid container 10. In addition, the abnormality determination result is written in the EEPROM 8 mounted in the liquid container 10. Accordingly, a manufacturer of the liquid container 10 can obtain information on abnormality frequency occurring in the liquid level detector 3 and information on manufacture dates, manufacture lines, types of ink, colors, and the like in which abnormality easily occurs, by recovering the used liquid container 10 and analyzing the data written in the EEPROM 8.

The process of determining whether the ink exists may be performed after the drive of the pressurizing pump 23 in the abnormality determination process of Step S70. Specifically, after the drive of the pressurizing pump 23, the liquid level signal is received by applying the drive signal to the liquid level detector 3. Then, the received signal is analyzed with reference to FIG. 4. When the received signal is the ink non-existence signal, a message indicating the ink does not remain and a message prompting exchange of the liquid container 10 are displayed on a predetermined display unit provided in the liquid ejecting apparatus 20. Alternatively, when the received signal is the ink existence signal, the control circuit 22 can perform a printing process or the like.

B. Second Embodiment

In the first embodiment described above, the abnormality determination process performed when the liquid ejecting apparatus 20 is turned on has been described. According to a second embodiment, an abnormality determination process accompanied with a printing process will be described.

According to this embodiment, the liquid ejecting apparatus 20 includes a liquid level estimation unit 65 illustrated by a dashed line in FIG. 1. The liquid level estimation unit 65 has a function estimating an amount of consumption ink by counting the number of ink drops ejected from the print head 21 and multiplying the count number of ink drops and an amount of consumption ink per one ink drop (for example, 2 picoliter). The liquid level estimation unit 65 has a function counting the number of ink drops ejected during the printing process and storing the counted value in a RAM 63.

Figure 6:
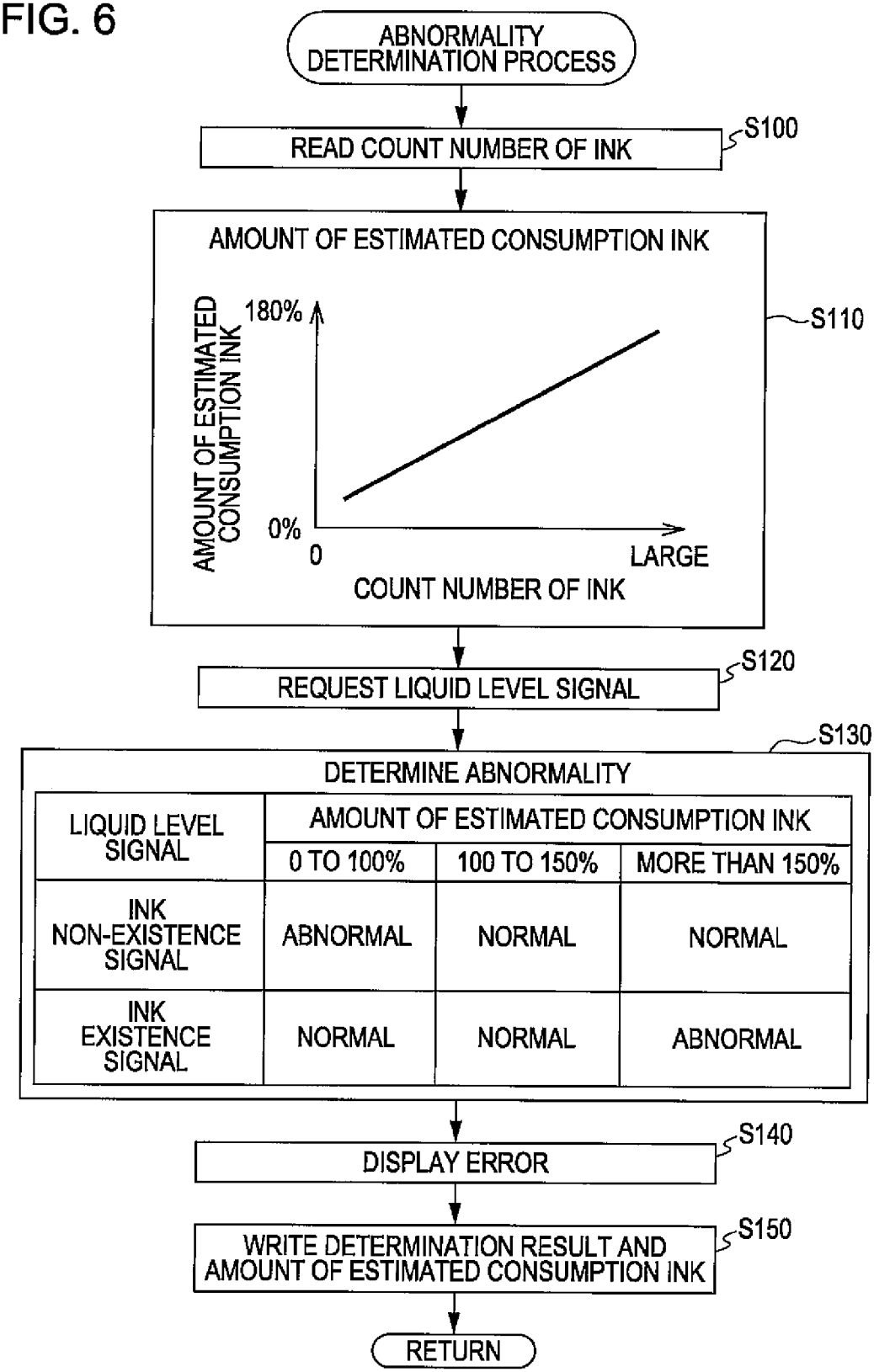
FIG. 6 is a flowchart illustrating an abnormality determination process according to a second embodiment.

FIG. 6 is a flowchart illustrating the abnormality determination process performed according to the second embodiment. In this embodiment, the abnormality determination process is performed whenever the printing process performed by the liquid ejecting apparatus 20 finishes.

Upon performing the abnormality determination process, the control circuit 22 first reads the count number of ink drops ejected during the previous printing process from the RAM 63 (Step S100). Subsequently, an cumulative amount of consumption ink after exchange of the liquid container 10 is estimated by adding the read count number to the total number counted up to the present time (Step S110). As illustrating in FIG. 6, the cumulative amount of consumption ink linearly increases with an increase in the count number.

In FIG. 6, an amount of estimated consumption ink is represented by a percentage unit. In the EEPROM 8 mounted in the liquid container 10, the amount of ink filled in the liquid container 10 is stored as the capacity data in the individual information area. Accordingly, the liquid level estimation unit 65 can calculate a ratio of the cumulative amount of consumption ink to the maximum amount of ink by reading the capacity data. The reason for representing the amount of estimated consumption ink beyond a 100% scale is that a volume of the ink drop ejected from the print head 21 or an initial amount of ink contained in the ink pack 4 is different. For example, the amount of consumption ink per one ink drop used for the count process of the liquid level estimation unit 65 is set to the supposed most amount of ink in consideration of the declination of the amount of ink ejected from the print head 21. That is because the amount of estimated consumption ink may is 100% or more at the time at which the liquid level detector 3 detects the non-existence of ink.

Subsequently, the control circuit 22 receives the liquid level signal from the liquid level detector 3 of the liquid container 10 by applying a predetermined drive signal to the liquid level detector 3 of the liquid container 10 (Step S120). When receiving the liquid level signal, the control circuit 22 analyzes the cumulative amount of estimated consumption ink in Step S110 and the liquid level signal received in Step S120, and then determines whether abnormality occurs in the liquid container 10 (Step S130).

Specifically, the control circuit 22 determines that the abnormality occurs in the liquid level detector 3, when the cumulative amount of estimated consumption ink is less than 100% but the ink non-existence signal is received. The reason for determining that the abnormality occurs is that the ink remains in the ink pack 4 and the ink existence signal has to be originally output when the cumulative amount of estimated consumption ink is less than the range from 0% to 100%, as known from the method of setting the amount of consumption ink per one ink drop used for the count in the liquid level estimation unit 65 described above, for example.

The control circuit 22 also determines that the abnormality occurs in the liquid level detector 3, when the cumulative amount of estimated consumption ink is equal to or more than 150% but the ink existence signal is received. The reason for determining that the abnormality occurs is that the ink remaining in the ink pack 4 is equal to or less than the predetermined level and the ink non-existence signal has to be originally output when the cumulative amount of estimated consumption ink exceeds 150%, even though the volume of the ink ejected from the print head 21 or an individual difference of the capacity of the ink pack 4 is taken into consideration.

In contrast, the control circuit 22 determines that no abnormality occurs in the liquid level detector 3 (normal) when the cumulative amount of estimated consumption ink is equal to or more than 100% and the ink non-existence signal is received and when the cumulative amount of estimated consumption ink is less than 150% and the ink existence signal is received.

The control circuit 22 displays an error message indicating that the abnormality occurs on the display unit included in the liquid ejecting apparatus 20, when determining that the abnormality occurs in Step S130 (Step S140). Subsequently, the result determined in Step S130 is written as abnormality determination result data in the writing area of the EEPROM 8 mounted in the liquid container 10 (Step S150). At this time, the control circuit 22 simultaneously writes the amount of estimated consumption ink as the abnormality determination result data in the EEPROM 8.

According to the second embodiment described above, the liquid ejecting apparatus 20 can determine whether the abnormality occurs in the liquid level detector 3 of the liquid container 10 by comparing and analyzing the amount of estimated consumption ink and the liquid level detected by the liquid level detector 3. In addition, the abnormality determination result and the amount of estimated consumption ink are written in the EEPROM 8 mounted in the liquid container 10. Accordingly, a manufacturer of the liquid container 10 can obtain information on a frequency how many times abnormality occurs in the liquid level detector 3 and information on a manufacture date, a manufacture line, a type of ink, a color, and the like in which abnormality easily occurs, by recovering the used liquid container 10 and analyzing the data written in the EEPROM 8.

The abnormality determination process described in the second embodiment is performed at timing different from timing at which the abnormality determination process is performed in the first embodiment. Accordingly, the abnormality determination processes may be performed in a combination manner.

C. Modified Examples

As described above, various embodiments of the invention have been described. However, the invention is not limited to these embodiments, but may use various configurations without departing the gist of the invention, of course. For example, the invention may be modified as follows.

Modified Example 1

In the above-described embodiments, an exclusive area where the abnormal determination data are written is provided in advance in the EEPROM 8. However, the control circuit 22 may replace information written in the EEPROM 8 with the abnormality determination result data. The replaced information may be data which is not important in the analysis of the used liquid container 10. For example, since the type number data, the ink type data, the color data, and the manufacture date data shown in FIG. 2 can be confirmed in a label attached to the liquid container 10, the type number data, the ink type data, the color data, and the manufacture date data can be rewritten.

Modified Example 2

In the above-described embodiments, the data indicating that the liquid level detector 3 is normal is written in the EEPROM 8, even when it is determined that the liquid level detector 3 is normal. However, data indicating "normality" as initial information may be stored in the EEPROM 8. In addition, the abnormality determination result may be written only when the abnormality occurs.

Modified Example 3

In the above-described embodiments, the detecting of the abnormality of the liquid level detector 3 is performed in consideration of the drive state of the pressurizing pump 23 or the amount of estimated consumption ink. For example, however, it may be determined that the abnormality occurs in the liquid level detector 3, when the control circuit 22 cannot transmit the predetermined drive signal to the liquid level detector 3 or no reply is transmitted from the liquid level detector 3 due to a short circuit of a wiring between the liquid level detector 3 and the interface board 7, or when a unusual waveform or unusual voltage from the liquid level detector 3 is detected.

Modified Example 4

In the above-described embodiments, the liquid ejecting apparatus 20 is an ink jet printing apparatus. However, the liquid ejecting apparatus 20 may be other apparatuses. For example, an apparatus including a color material ejecting head used to manufacture a color filter such as a liquid crystal display, an organic EL display, an apparatus including an electrode material (conductive paste) ejecting head used to form electrodes such as a field emission display (FED), an apparatus including a bio-organism ejecting head used to manufacture a bio chip, an apparatus including a sample ejecting head as a precise pipette, and an apparatus such as a printing machine or a micro dispenser may be as the liquid ejecting apparatus.

The entire disclosure of Japanese Patent Application No. 2007-245502, filed Sep. 21, 2007 is expressly incorporated by reference herein.

What is claimed is:

1. A liquid ejecting apparatus which ejects a liquid supplied from a liquid container including a storage unit in which data is written and a liquid level detector which detects a liquid level of the contained liquid, the liquid ejecting apparatus comprising:

an abnormality detecting unit which receives a signal indicating the liquid level of the liquid from the liquid level detector and analyzes the signal to detect abnormality of the liquid level detector; and a writing unit which writes data indicating the abnormality in the storage unit when the abnormality is detected.

2. The liquid ejecting apparatus according to claim 1, further comprising:

a pressurizing unit which pressurizes the liquid contained in the liquid container, wherein the liquid container supplies the liquid to the liquid ejecting apparatus when the liquid is pressurized by the pressurizing unit, and wherein the abnormality detecting unit analyzes the signal indicating the liquid level of the liquid received from the liquid level detector and whether the pressurizing unit pressurizes the liquid to detect the abnormality of the liquid level detector.

3. The liquid ejecting apparatus according to claim 1, further comprising:

an estimation unit which estimates an amount of consumption liquid on the basis of the number of times of liquid ejection, wherein the abnormality detecting unit analyzes the signal indicating the liquid level of the liquid received from the liquid level detector and the amount of estimated consumption liquid to detect the abnormality of the liquid level detector.

4. The liquid ejecting apparatus according to claim 3, wherein the liquid level detector outputs a low level signal indicating that the liquid level is low when the liquid level of the liquid contained in the liquid container is equal to or less than a predetermined level, and wherein the abnormality detecting unit determines that the abnormality occurs when the amount of estimated consumption liquid does not reach the predetermined level but the low level signal is received.

5. The liquid ejecting apparatus according to claim 3, wherein the liquid level detector outputs a low level signal indicating that the liquid level is low when the liquid level of the liquid contained in the liquid container is equal to or less than a predetermined level, and wherein the abnormality detecting unit determines that the abnormality occurs when the amount of estimated consumption liquid exceeds the predetermined level but the low level signal is not received.

6. The liquid ejecting apparatus according to claim 3, wherein the writing unit writes the data indicating the abnormality and the data indicating the amount of estimated consumption liquid in the storage unit.

7. The liquid ejecting apparatus according to claim 1, wherein the storage unit includes an exclusive area where only the data indicating the abnormality is written.

8. The liquid ejecting apparatus according to claim 1, wherein individual information on an individual liquid container is written in the storage unit, and wherein the writing unit rewrites at least a part of the individual information with the data indicating the abnormality.

9. A liquid container which contains a liquid to be supplied to a liquid ejecting apparatus, the liquid container comprising:

a liquid level detector which detects a liquid level of the liquid contained in the liquid container and outputs a signal indicating the liquid level of the liquid to the liquid ejecting apparatus; and a storage unit which includes a storage area where data indicating abnormality of the liquid level detector is written by the liquid ejecting apparatus when the abnormality is detected by analyzing the signal indicating the liquid level of the liquid by the liquid ejecting apparatus.

10. The liquid container according to claim 9, wherein the storage unit includes an exclusive area where only the data indicating the abnormality is written.

11. The liquid container according to claim 9, wherein individual information on an individual liquid container is written in the storage unit, and wherein the writing unit rewrites at least a part of the individual information with the data indicating the abnormality.

12. A liquid ejecting apparatus comprising the liquid container according to claim 9, an abnormality detecting unit which receives the signal indicating the liquid level of the liquid from the liquid level detector and analyzes the signal to detect the abnormality of the liquid level detector;

a writing unit which writes the data indicating the abnormality in the storage unit when the abnormality is detected; and an ejection unit which ejects the liquid supplied from the liquid container.

13. A method of writing data in a storage unit by a liquid ejecting apparatus which ejects a liquid supplied from a liquid container including the storage unit, the method comprising:

detecting a liquid level of the liquid contained in the liquid container by a liquid level detector provided in the liquid container;

analyzing the detected liquid level of the liquid to detect abnormality of the liquid level detector; and writing data indicating the abnormality in the storage unit provided in the liquid container when the abnormality is detected.

* * * * *